US009704666B2

(12) United States Patent
Kuo

(10) Patent No.: US 9,704,666 B2
(45) Date of Patent: Jul. 11, 2017

(54) PUSHBUTTON SWITCH

(71) Applicant: Excel Cell Electronic Co., Ltd., Taichung (TW)

(72) Inventor: Yung-Ming Kuo, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 16 days.

(21) Appl. No.: 14/739,445

(22) Filed: Jun. 15, 2015

(65) Prior Publication Data

US 2015/0380184 A1 Dec. 31, 2015

(30) Foreign Application Priority Data

Jun. 25, 2014 (TW) ..... 103121929 A

(51) Int. Cl.
*H01H 3/12* (2006.01)
*H01H 13/14* (2006.01)
*H01H 13/52* (2006.01)

(52) U.S. Cl.
CPC ..... *H01H 13/14* (2013.01); *H01H 3/122* (2013.01); *H01H 13/52* (2013.01); *H01H 2235/028* (2013.01)

(58) Field of Classification Search
CPC ..... H01H 13/14; H01H 13/52; H01H 3/122; H01H 2235/028
USPC ..... 200/341, 344, 520
See application file for complete search history.

(56) References Cited

U.S. PATENT DOCUMENTS 5,901,837 A * 5/1999 Aimi ..... H01H 3/125 200/344
6,755,582 B2 * 6/2004 Won ..... G06F 3/0489 200/344
2014/0174897 A1 * 6/2014 Cao ..... H01H 13/52 200/290

* cited by examiner

*Primary Examiner* — Renee S Luebke
*Assistant Examiner* — Lheiren Mae A Caroc
(74) *Attorney, Agent, or Firm* — Trop Pruner & Hu, P.C.

(57) ABSTRACT

A pushbutton switch for a switch assembly includes a pushbutton unit and a resilient member. The pushbutton unit includes a mounting seat and a pushbutton that covers the mounting seat. The resilient member is disposed between the mounting seat and the pushbutton, and has an insert connected to the mounting seat and having opposite ends that are spaced apart in an extending direction, and two resilient arms extending respectively from the opposite ends of the insert. Each resilient arm has two contact end sections abutting against the pushbutton and spaced apart in a transverse direction, and is deformed when the pushbutton moves to a contact position so as to generate a restoring force which urges the pushbutton to a non-contact position.

9 Claims, 13 Drawing Sheets

PUSHBUTTON SWITCH

CROSS-REFERENCE TO RELATED APPLICATION

This application claims priority of Taiwanese Application No. 103121929, filed on Jun. 25, 2014.

FIELD OF THE DISCLOSURE

The disclosure relates to a pushbutton switch, and more particularly to a pushbutton switch having a resilient member.

BACKGROUND OF THE DISCLOSURE

Referring to FIGS. 1 and 2, a first conventional pushbutton switch 1 is suited for a switch assembly (not shown). The first conventional pushbutton switch 1 includes a mount seat 11, a pushbutton 12 that covers the mount seat 11 and cooperates with the mount seat 11 to define a receiving space 13, and a spring 14 that is disposed inside the receiving space 13. The spring 14 has two opposite ends that respectively abut against the mount seat 11 and the pushbutton 12, and urges the pushbutton 12 to move away from the mount seat 11.

Referring to FIGS. 3 and 4, in order to activate the switch assembly, the pushbutton 12 is pushed to be in proximity to the mount seat 11, thereby causing compression of the spring 14. However, since the spring 14 only contacts a center portion of the pushbutton 12, when an external force is exerted at a corner of the pushbutton 12, the external force may not be effectively transmitted to the spring 14. As such, actuation of the switch assembly may be hampered by inefficient compression of the spring 14.

Referring to FIGS. 5 and 6, a second conventional pushbutton switch 1' for connecting to a switch assembly (not shown) includes a pushbutton 12, a mount seat 11 that is covered by the pushbutton 12, and four springs 14 that are respectively disposed below four corners of the pushbutton 12. However, since the springs 14 are independent from each other, when one of the corners of the pushbutton 12 is affected by an external force, only a corresponding one of the springs 14 is compressed by the external force. That is to say, the external force is unable to be transmitted to the rest of the springs 14 under that situation. As a result, the actuation of the switch assembly (not shown) is still hampered.

Moreover, utilization and installation of four of the springs 14 leads to a relatively high manufacturing cost of the second conventional pushbutton switch 1'.

SUMMARY OF THE DISCLOSURE

Therefore, an object of the present disclosure is to provide a pushbutton switch that can alleviate at least one of the drawbacks of the prior arts.

According to the present disclosure, the pushbutton switch is for a switch assembly. The switch assembly includes a housing, two spaced-apart terminals that extend into the housing, two first contacts that are disposed in the housing and that are respectively disposed on the terminals, and a second contact that is disposed inside the housing. The pushbutton switch includes a pushbutton unit and a resilient member.

The pushbutton unit includes a mounting seat and a pushbutton. The mounting seat is for being disposed outside of and proximate to the housing, and is formed with an engaging groove. The pushbutton covers the mounting seat and cooperates with the mounting seat to define a receiving space. The pushbutton is in connection with the second contact, and is movable together with the second contact relative to the mounting seat between a contact position, where the second contact contacts the first contacts, and a non-contact position, where the second contact is away from the first contacts.

The resilient member is disposed in the receiving space, and has an insert and two resilient arms. The insert engages the engaging groove, and has opposite ends spaced apart from each other in an extending direction. The resilient arms extend respectively from the opposite ends of the insert. Each of the resilient arms has two contact end sections that abut resiliently against the pushbutton, and that are spaced apart from each other in a transverse direction transverse to the extending direction.

The resilient arms are resiliently deformed when the pushbutton moves from the non-contact position to the contact position so as to generate a restoring force which urges the pushbutton to the non-contact position.

BRIEF DESCRIPTION OF THE DRAWINGS

Other features and advantages of the present disclosure will become apparent in the following detailed description of the embodiments with reference to the accompanying drawings, of which.

DETAILED DESCRIPTION OF THE EMBODIMENTS

Figure 1:
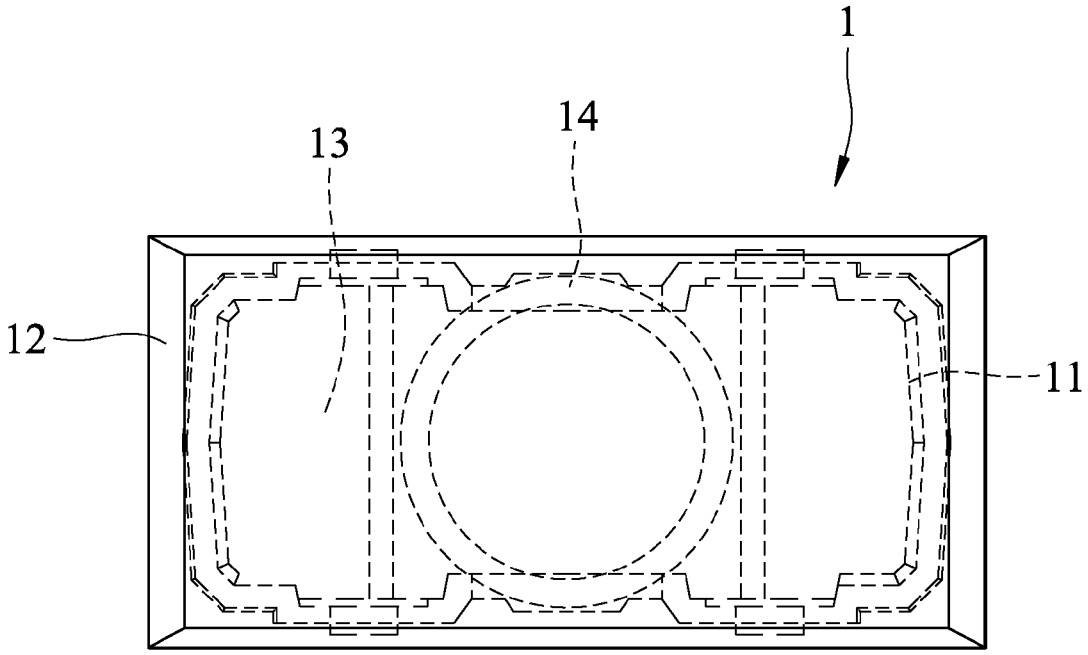
FIG.1 PRIOR ART
FIG. 1 is a top view illustrating a first conventional pushbutton switch.
Figure 2:
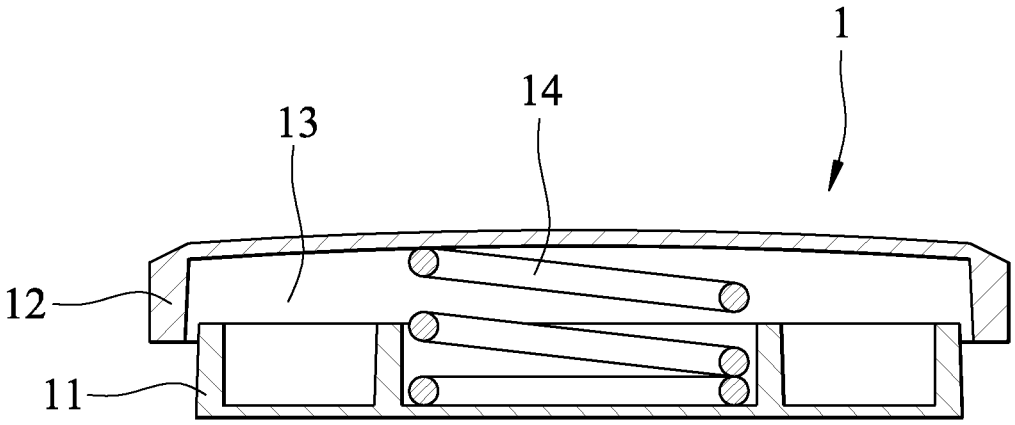
FIG.2 PRIOR ART
FIG. 2 is a sectional view of the first conventional pushbutton switch.
Figure 3:
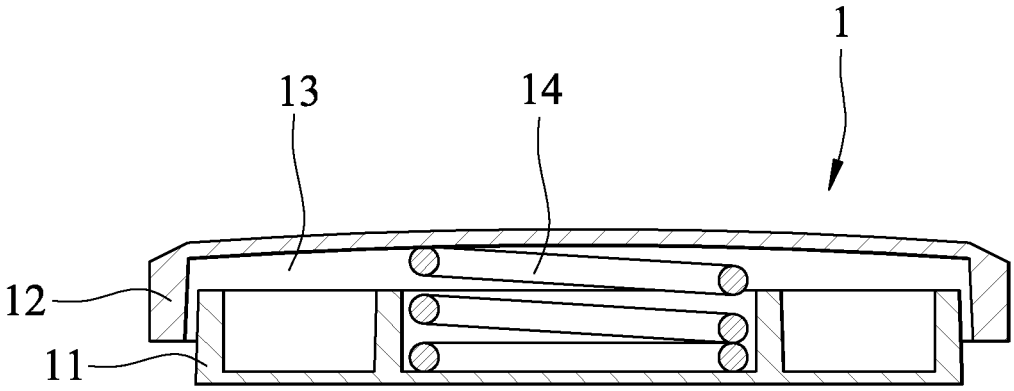
FIG.3 PRIOR ART
FIG. 3 is a sectional view of the first conventional pushbutton switch when pressed.
Figure 4:
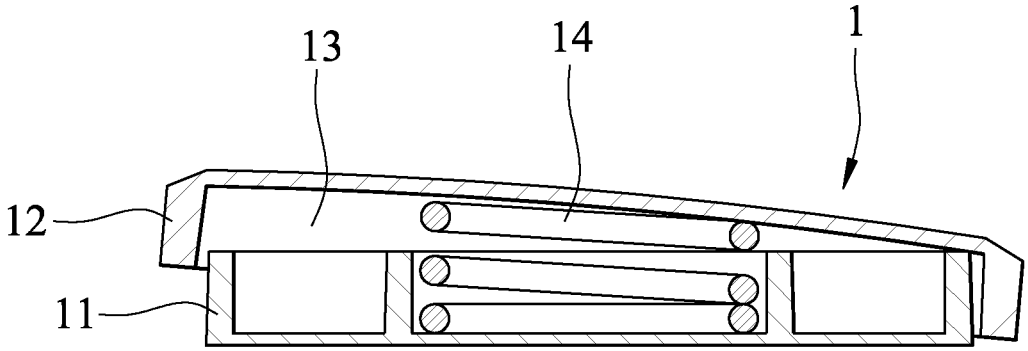
FIG.4 PRIOR ART
FIG. 4 is a sectional view of the first conventional pushbutton switch when a corner of a pushbutton is pressed.
Figure 5:
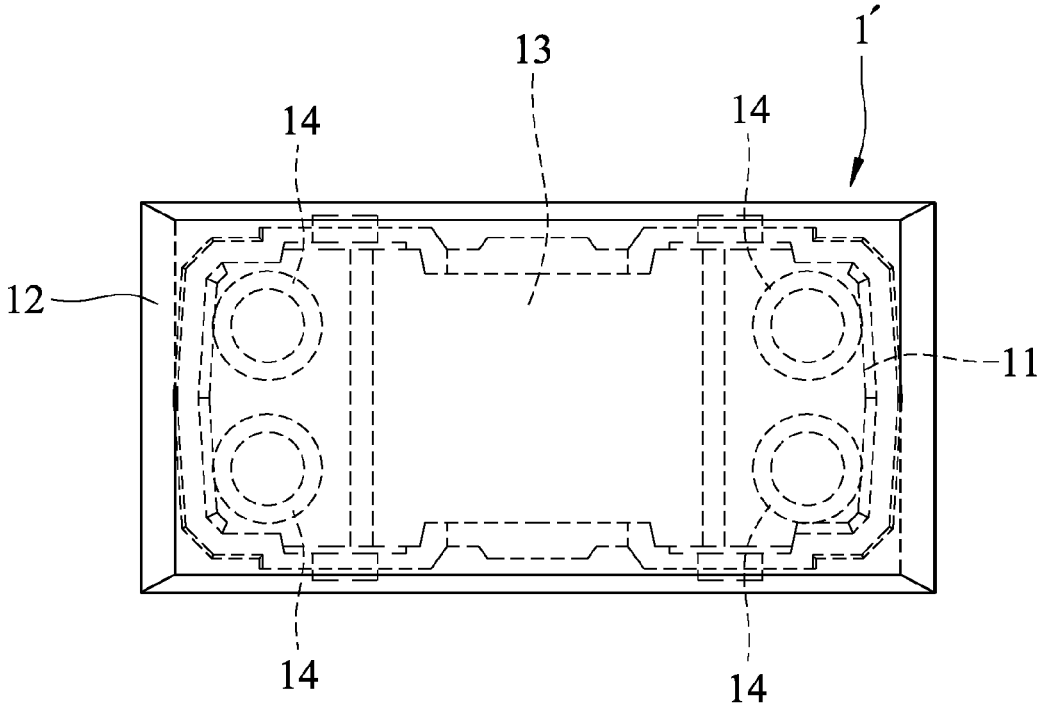
FIG.5 PRIOR ART
FIG. 5 is a top view illustrating a second conventional pushbutton switch that has four springs.
Figure 6:
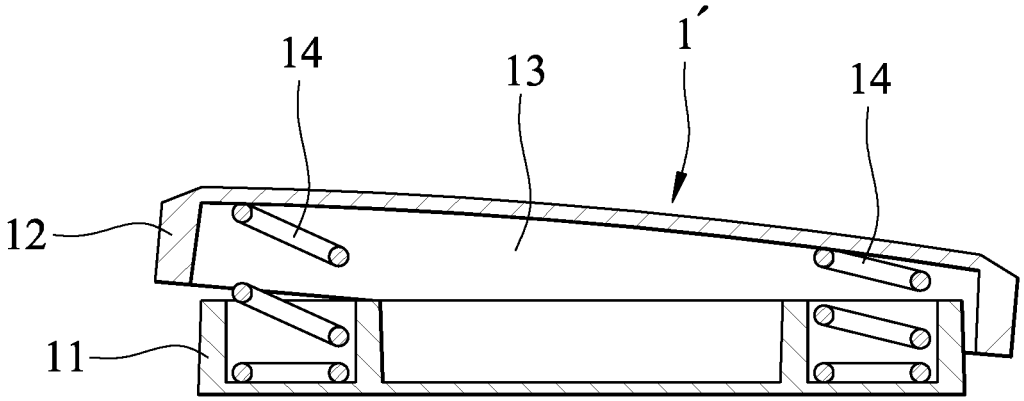
FIG.6 PRIOR ART
FIG. 6 is a sectional view of the second conventional pushbutton switch when a corner of a pushbutton is pressed.

Before the present disclosure is de scribed in greater detail, it should be noted that like elements are denoted by the same reference numerals throughout the disclosure.

Figure 7:
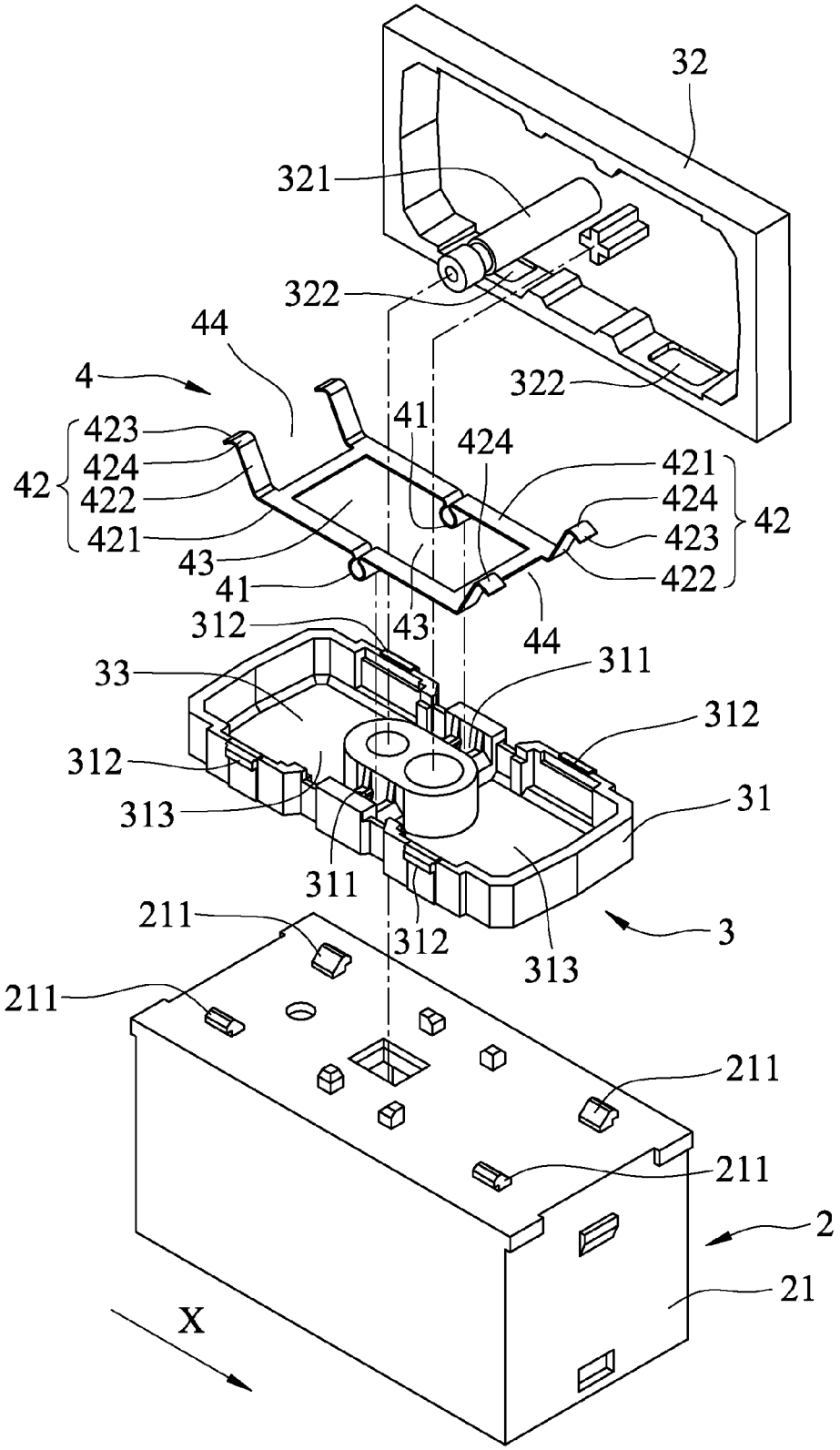
FIG. 7 is an exploded perspective view illustrating the first embodiment of a pushbutton switch according to the present disclosure.
Figure 8:
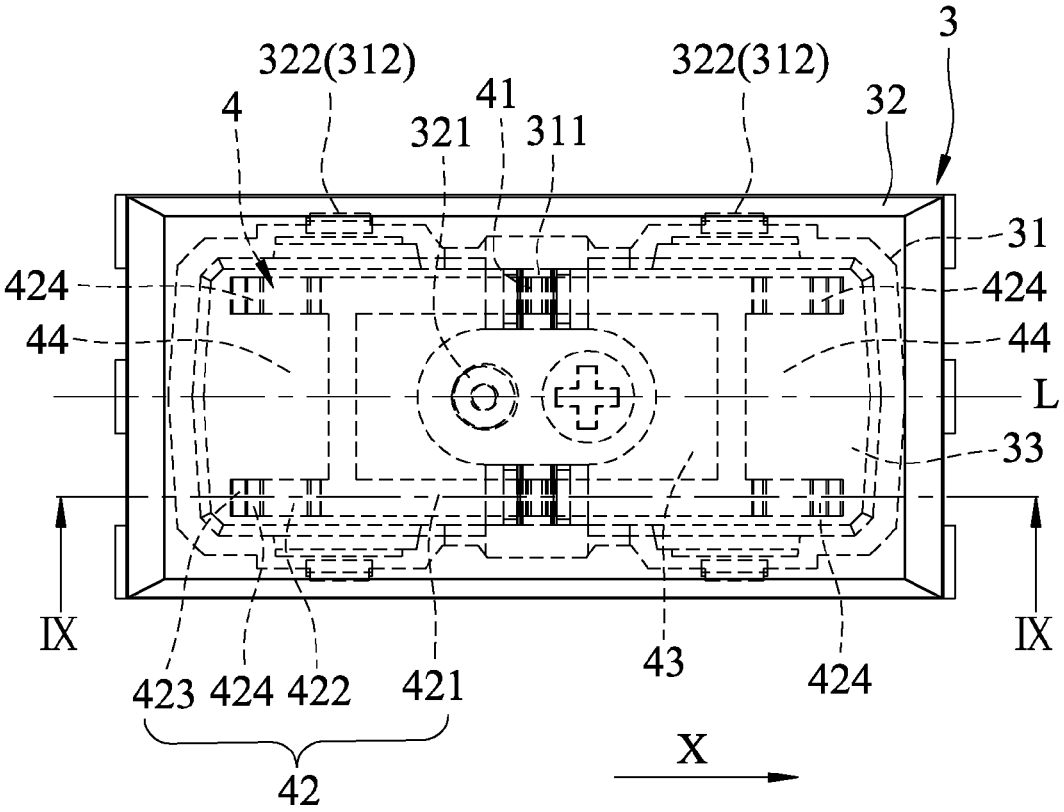
FIG. 8 is atop view illustrating a pushbutton and a resilient member of the first embodiment.
Figure 9:
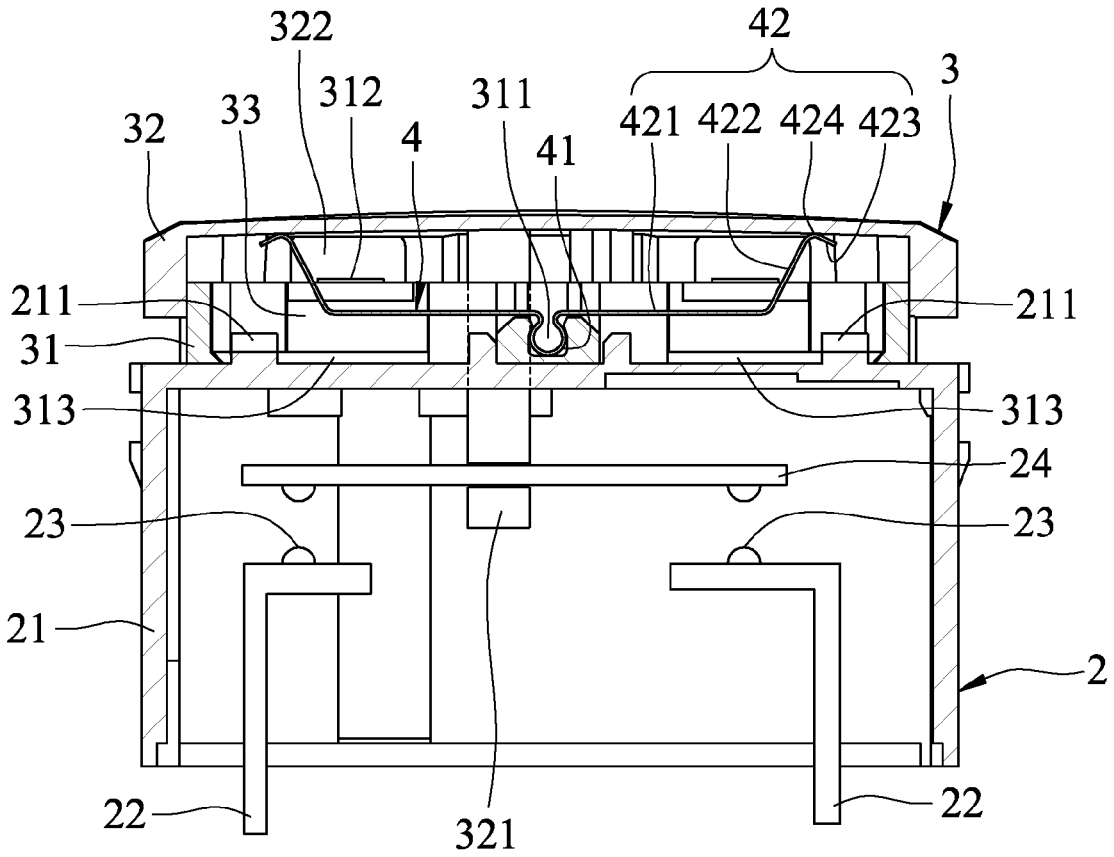
FIG. 9 is a sectional view of the first embodiment taken along line IX-IX in FIG. 8, illustrating a pushbutton at a non-contact position.

Referring to FIGS. 7 to 9, the first embodiment of a pushbutton switch according to the present disclosure is suitable for a switch assembly 2. The switch assembly 2 includes a housing 21, two spaced-apart terminals 22 that extend into the housing 21, two first contacts 23 that are disposed in the housing 21 and that are respectively disposed on the terminals 22, and a second contact 24 that is disposed inside the housing 21. The housing 21 includes a main body that retains the first and second contacts 23, 24 therein, and four engagement blocks 211 that are respectively formed on four corners of a rectangular top surface of the main body. The pushbutton switch includes a pushbutton unit 3 and a resilient member 4.

The pushbutton unit 3 includes a mounting seat 31 that is disposed outside of and proximate to the housing 21, and a pushbutton 32 that covers the mounting seat 31 and that cooperates with the mounting seat 31 to define a receiving space 33.

As shown in FIGS. 7 and 9, in this embodiment, the mounting seat 31 is connected fixedly to the housing 21, and includes a substantially-rectangular surrounding part, and an intermediate part that is disposed within and connected to the surrounding part, that is formed with two engaging grooves 311, and that divides an inner space defined by the surrounding part into two space portions 313. The mounting seat 31 further includes four slide blocks 312 that project outwardly from the surrounding part. Two of the slide blocks 312 are located respectively at opposite end portions of one longitudinal side of the surrounding part, and the other two of the slide blocks 312 are located respectively at opposite end portions of an opposite longitudinal side of the surrounding part. The engagement blocks 211 of the switch assembly 2 are inserted into the space portions 313 and engage an inner surface of the surrounding part of the mounting seat 31.

In this embodiment, the pushbutton 32 has a main segment, and a drive rod 321 that is located in a central portion of the main segment, that extends through the mounting seat 31, and that is in connection with the second contact 24 of the switch assembly 2. The pushbutton 32 is movable together with the second contact 24 relative to the mounting seat 31. The main segment of the pushbutton 32 is formed with four slide grooves 322 (only two are visible in FIGS. 7 and 9) that respectively receive the slide blocks 312.

In this embodiment, the pushbutton 32 is movable together with the second contact 24 relative to the mounting seat 31 between a contact position (see FIG. 10), where the second contact 24 contacts the first contacts 23, and a non-contact position (see FIG. 9), where the second contact 24 is separated from the first contacts 23. Movement of the pushbutton 32 between the contact and non-contact positions results in a relative movement between the slide grooves 322 and the slide blocks 312. It should be noted that the number of the slide blocks 312 and the slide grooves 322 may vary in other embodiments of this invention.

In this embodiment, the resilient member 4 is disposed in the receiving space 33, and has two inserts 41 and two resilient arms 42. In this embodiment, the resilient member 4 is a one-piece member.

The inserts 41 engage respectively the engaging grooves 311. Each of the inserts 41 has opposite ends spaced apart from each other in an extending direction (X) (see FIG. 7). In this embodiment, each of the inserts 41 has a drop-shaped cross section.

In this embodiment, each of the resilient arms 42 has a first resilient portion 421 extending in the extending direction (X), a second resilient portion 422, and a support portion 423. Each of the resilient arms 42 further has a through hole 43 formed in the first resilient portion 421 so as to divide the first resilient portion 421 into first and second sectors. The through holes 43 of the resilient arms 42 are communicated with each other. The drive rod 321 extends through one of the through holes 43 of the resilient arms 42. Specifically, the through holes 43 of the resilient arms 42 are substantially rectangular in shape. The first sectors of the first resilient portions 421 of the resilient arms 42 extend respectively from the opposite ends of one of the inserts 41, and the second sectors of the first resilient portions 421 of the resilient arms 42 extend respectively from the opposite ends of the other one of the inserts 41. The second resilient portion 422 extends obliquely from a distal end of the first resilient portion 421 toward the pushbutton 32. The support portion 423 is connected to and bent from the second resilient portion 422, and has two contact end sections 424 that abut resiliently against the pushbutton 32, and that are spaced apart from each other in a transverse direction transverse to the extending direction (X). In addition, the resilient arms 42 are resiliently deformed when the pushbutton 32 moves from the non-contact position to the contact position so as to generate a restoring force which urges the pushbutton 32 to the non-contact position. Each of the resilient arms 42 further has an opening 44 that is formed in the second resilient portion 422 and the support portion 423, and that separates the contact end sections 424 from each other. For each of the resilient arms 42, the through hole 43 and the opening 44 are spaced apart from each other. In this embodiment, the resilient arms 42 are symmetrical with respect to a central axis (L) (see FIG. 8) parallel with the extending direction (X), such that the contact end sections 424 of each of the resilient arms 42 are respectively disposed on two opposite sides of the central axis (L). Specifically, the four contact end sections 424 of the resilient arms 42 are disposed to correspond in position to the four corners of the pushbutton 32, respectively, such that the pushbutton 32 is uniformly urged by the resilient arms 42.

It should be noted that each of the resilient arms 42 may omit the first resilient portion 421 and only have the second resilient portion 422 that is directly connected to the inserts 41. In such a manner, the resilient arms 42 are still resiliently deformable to generate the restoring force for urging the pushbutton 32 to the non-contact position.

Referring to FIG. 9, when the pushbutton 32 is at the non-contact position, the second contact 24 is away from the first contacts 23, so that a circuit is not formed between the first contacts 23.

Figure 10:
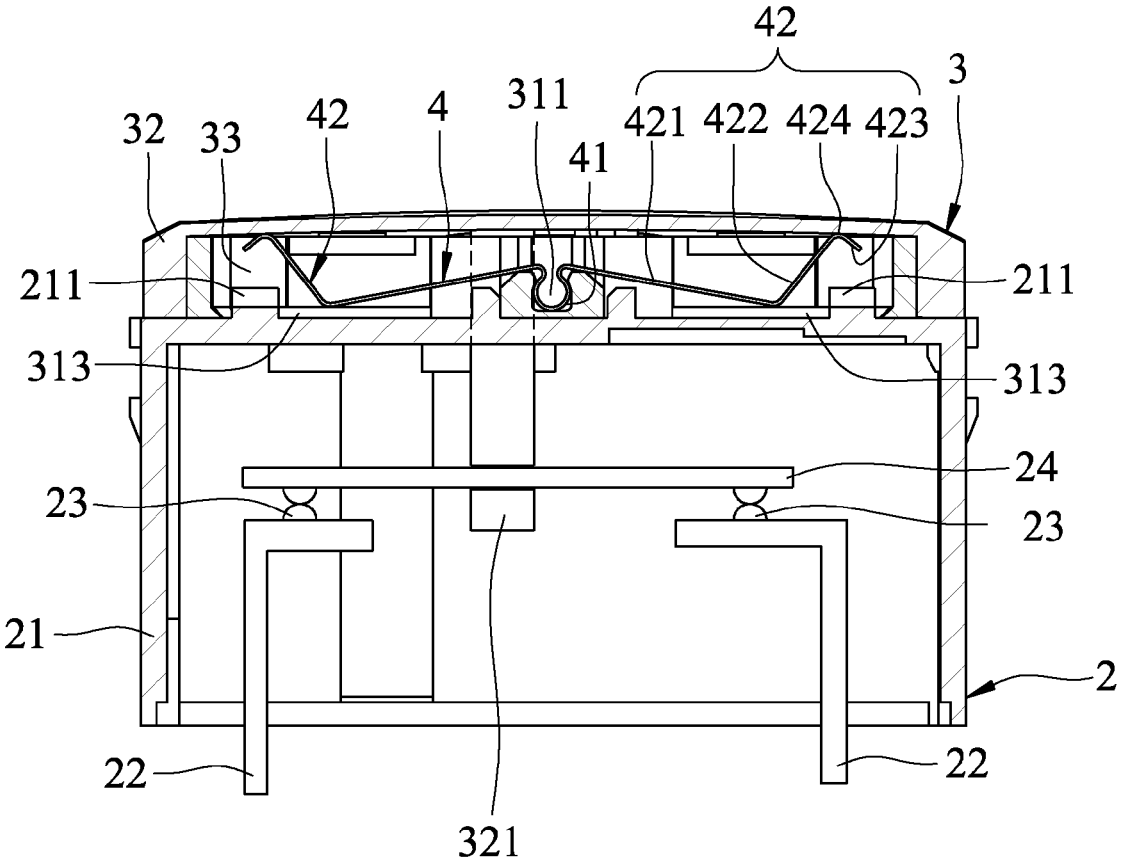
FIG. 10 is a view similar to FIG. 9, but illustrating the pushbutton at a contact position.

Referring to FIG. 10, when the pushbutton 32 is pressed to the contact position, the resilient arms 42 are thereby deformed and the drive rod 321 drives the second contact 24 to contact the first contacts 23. As a result, a circuit is formed between the first contacts 23.

When the pushbutton 32 is released from the contact position, the restoring force of the resilient arms 42 restores the pushbutton 32 to the non-contact position. Accordingly, the drive rod 321 drives the second contact 24 to be separated from the first contacts 23, such that the circuit between the first contacts 23 is disconnected.

Figure 11:
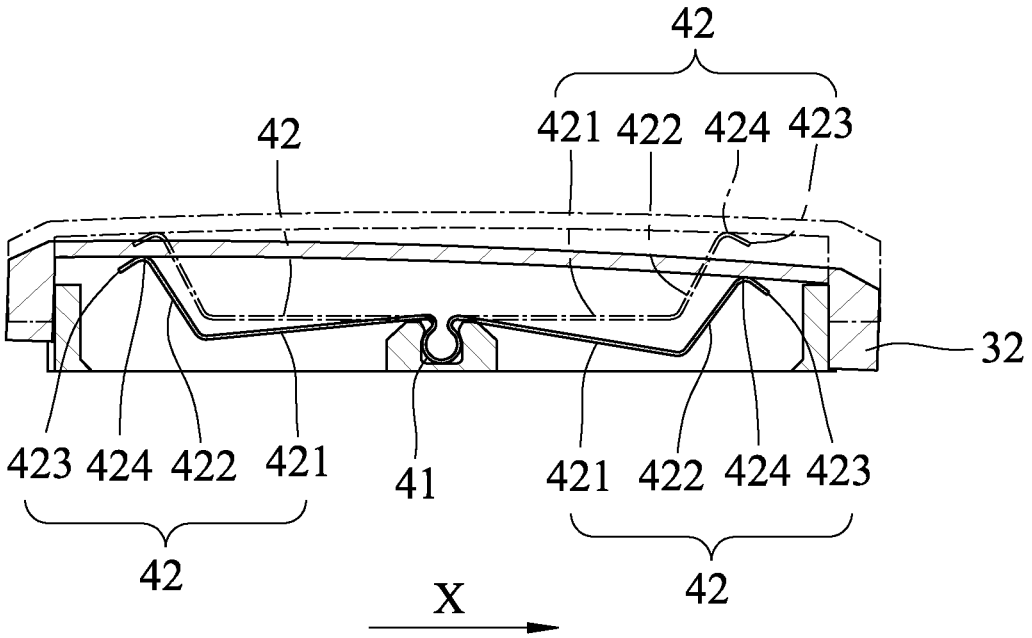
FIG. 11 is a sectional view illustrating deformation of a resilient member when a corner of the pushbutton is pressed from the non-contact position toward the contact position.

Referring to FIG. 11, deformation of the resilient arms 42 depends on torque effects. In this disclosure, for each of the resilient arms 42, the first resilient portion 421 has a length longer than that of the second resilient portion 422. As such, when the pushbutton 32 is pressed, the first resilient portions 421 of the resilient arms 42 are easily bent from the insert 41 to cause the deformation of the resilient arms 42, thereby imparting a relatively high sensitivity of the pushbutton switch.

When one of the corners of the main segment of the pushbutton 32 is pressed by an external force, the first and second sectors of the first resilient portion 421 of a corresponding one of the resilient arms 42 are affected and bent from the inserts 41. It is only until the first resilient portion 421 of the corresponding one of the resilient arms 42 is no more bendable will the second resilient portion 422 of the corresponding one of the resilient arms 42 intend to bend. Since the second resilient portion 422 of the corresponding one of the resilient arms 42 has the shorter length and is thus relatively more difficult to bend, the external force is gradually transmitted to the first resilient portion 421 of the other one of the resilient arms 42. Therefore, the external force is eventually transmitted to the contact end sections 424 of the other one of the resilient arms 42, such that the pushbutton 32 is smoothly movable relative to the mounting seat 31 regardless of where the external force acts on the pushbutton 32. Accordingly, smoothness of pressing the pushbutton 32 is enhanced.

In view of the above, the pushbutton switch has the following advantages:

1. Since the resilient member 4 is formed into one piece, and since the four contact end sections 424 of the resilient arms 42 respectively and resiliently abut against the four corners of the pushbutton 32, the external force can act anywhere on the pushbutton 32 to be uniformly transmitted through the resilient member 4. Accordingly, not only can smoothness of pressing the pushbutton 32 be enhanced, but the switch assembly 2 can also have increased touch sensitivity. In addition, the inserts 41 of the resilient member 4 are conveniently engageable with the engaging grooves 311 of the mounting seat 31, thereby facilitating assembly of the pushbutton switch.

2. The resilient member 4 provides a relatively short distance of movement for the pushbutton 32 between the contact position and the non-contact position without affecting the restoring force thereof for urging the pushbutton 32 toward the non-contact position, thereby making the pushbutton switch suitable for use in a miniaturized electronic device.

Figure 12:
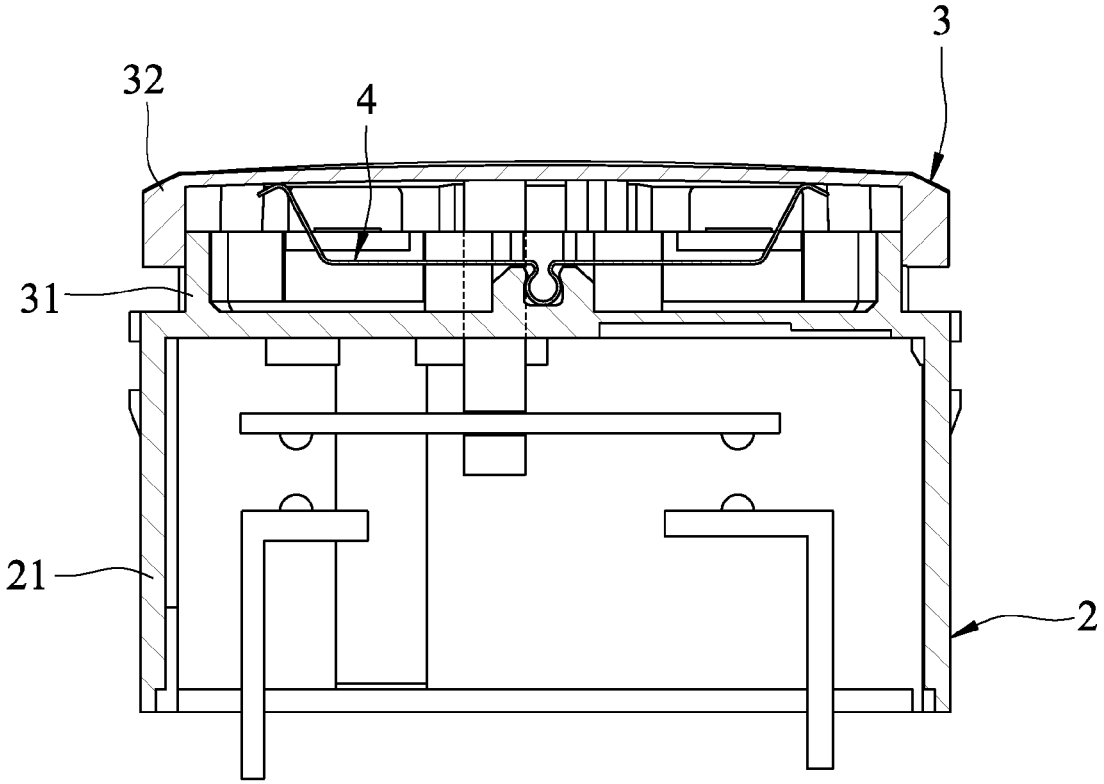
FIG. 12 is a sectional view of the second embodiment of a pushbutton switch according to the present disclosure.

Referring to FIG. 12, the second embodiment of a pushbutton switch according to the present disclosure is illustrated and differs in the configuration of the mounting seat 31 from the first embodiment. In the second embodiment, the mounting seat 31 of the pushbutton switch and the housing 21 of the switch assembly 2 are integrally formed as one piece.

Figure 13:
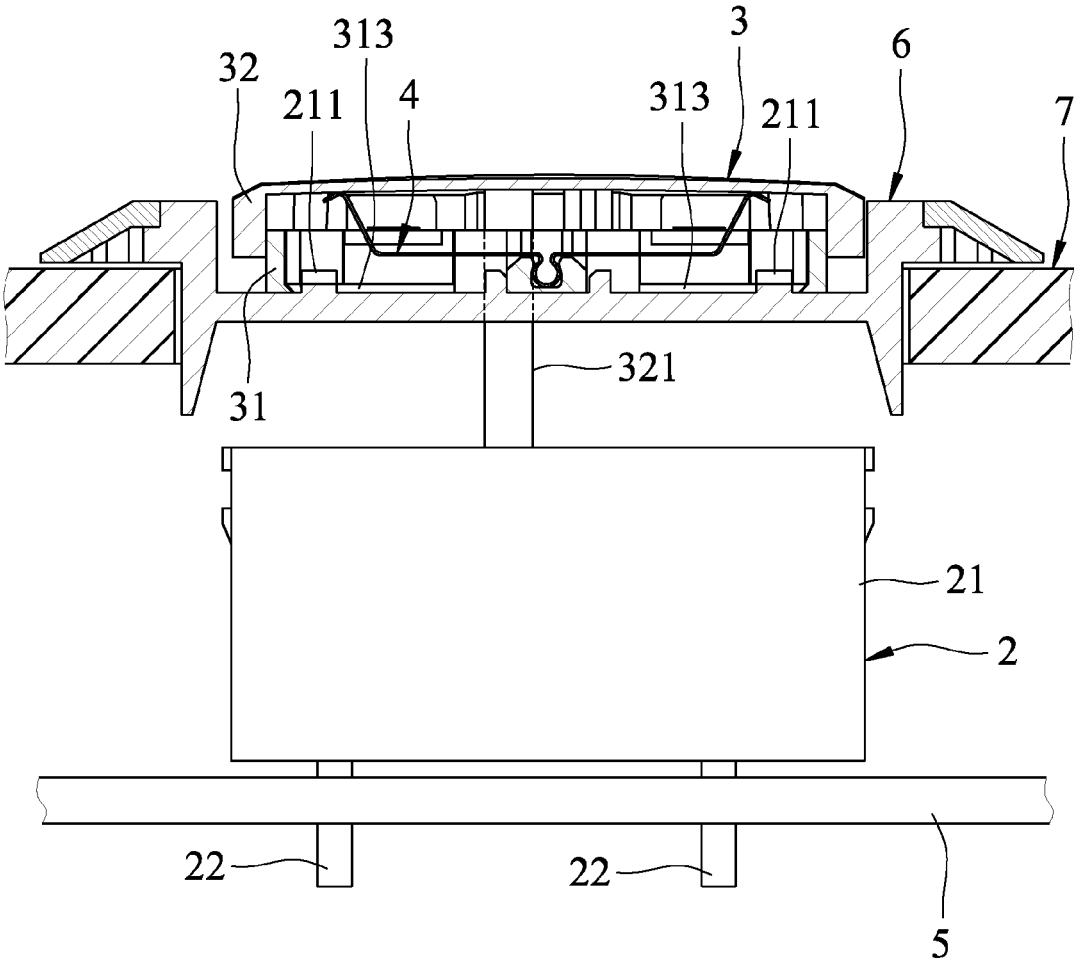
FIG. 13 is a sectional view of the third embodiment of a pushbutton switch according to the present disclosure.

FIG. 13 illustrates the third embodiment of a pushbutton switch according to the present disclosure, which has a configuration similar to that of the first embodiment. However, in the third embodiment, the terminals 22 of the switch assembly 2 extend through an electrical circuit board 5. The mounting seat 31 is connected to a fixture seat 6 that is mounted on a panel 7. The fixture seat 6 is interposed between the main segment of the pushbutton 32 and the housing 21. The mounting seat 31 and the fixture seat 6 may be molded as one piece.

While the present disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pushbutton switch for a switch assembly, the switch assembly including a housing, two spaced-apart terminals that extend into the housing, two first contacts that are disposed in the housing and that are respectively disposed on the terminals, and a second contact that is disposed inside the housing, said pushbutton switch comprising:

a pushbutton unit including a mounting seat that is for being disposed outside of and proximate to the housing, and that is formed with an engaging groove, and a pushbutton that covers said mounting seat and that cooperates with said mounting seat to define a receiving space, said pushbutton being in connection with the second contact and being movable together with the second contact relative to said mounting seat between a contact position, where the second contact contacts the first contacts, and a non-contact position, where the second contact is away from the first contacts; and a one-piece resilient member disposed in said receiving space having an insert that engages said engaging groove, and that has opposite ends spaced apart from each other in an extending direction, and two resilient arms that extend respectively from said opposite ends of said insert and gradually away from each other, each of said resilient arms having two contact end sections that abut resiliently against said pushbutton and that are spaced apart from each other in a transverse direction transverse to the extending direction;

wherein each of said resilient arms further has a first resilient portion that extends from a respective one of said opposite ends of said insert in the extending direction;

a second resilient portion that extends from a distal end of said first resilient portion toward said pushbutton; and a support portion that is connected to and bent from said second resilient portion, and that has said contact end sections; and wherein said resilient arms are resiliently deformed when said pushbutton moves from the non-contact position to the contact position so as to generate a restoring force which urges said pushbutton to the non-contact position.

2. The pushbutton switch as claimed in claim 1, wherein each of said resilient arms of said resilient member further has an opening that is formed in said second resilient portion and said support portion, and that separates said contact end sections from each other.

3. The pushbutton switch as claimed in claim 1, wherein said pushbutton has a drive rod that extends through said mounting seat for being in connection with the second contact.

4. The pushbutton switch as claimed in claim 3, wherein:

said drive rod is located in a central portion of said pushbutton; and each of said resilient arms further has a through hole that is formed in said first resilient portion, said through holes of said resilient arms being communicated with each other, said drive rod extending through said through hole of at least one of said resilient arms.

5. The pushbutton switch as claimed in claim 1, wherein:

said mounting seat further has two opposite slide blocks that project outwardly; and said pushbutton has two slide grooves that respectively receive said slide blocks, movement of said pushbutton between the contact and non-contact positions resulting in a relative movement between said slide grooves and said slide blocks.

6. The pushbutton switch as claimed in claim 1, wherein said mounting seat is connected fixedly with the housing of the switch assembly.

7. The pushbutton switch as claimed in claim 1, wherein said mounting seat and the housing of the switch assembly are integrally formed as one piece.

8. A pushbutton switch for a switch assembly, the switch assembly including a housing, two spaced-apart terminals that extend into the housing, two first contacts that are disposed in the housing and that are respectively disposed on the terminals, and a second contact that is disposed inside the housing, said pushbutton switch comprising:

a pushbutton unit including a mounting seat that is for being disposed outside of and proximate to the housing, and that is formed with an engaging groove, and a pushbutton that covers said mounting seat and that cooperates with said mounting seat to define a receiving space, said pushbutton having a drive rod that extends through said mounting seat for being in connection with the second contact and being movable together with the second contact relative to said mounting seat between a contact position, where the second contact contacts the first contacts, and a non-contact position, where the second contact is away from the first contacts; and a one-piece resilient member disposed in said receiving space having an insert that engages said engaging groove, and that has opposite ends spaced apart from each other in an extending direction, and two resilient arms that extend respectively from said opposite ends of said insert and gradually away from each other, each of said resilient arms having two contact end sections that abut resiliently against said pushbutton, and that are spaced apart from each other in a transverse direction transverse to the extending direction;

wherein said resilient arms are resiliently deformed when said pushbutton moves from the non-contact position to the contact position so as to generate a restoring force which urges said pushbutton to the non-contact position.

9. A pushbutton switch for a switch assembly, the switch assembly including a housing, two spaced-apart terminals that extend into the housing, two first contacts that are disposed in the housing and that are respectively disposed on the terminals, and a second contact that is disposed inside the housing, said pushbutton switch comprising:

a pushbutton unit including a mounting seat that is for being disposed outside of and proximate to the housing and that is formed with an engaging groove, said mounting seat further having two opposite slide blocks that project outwardly, and a pushbutton that covers said mounting seat and that cooperates with said mounting seat to define a receiving space, said pushbutton being in connection with the second contact and being movable together with the second contact relative to said mounting seat between a contact position, where the second contact contacts the first contacts, and a non-contact position, where the second contact is away from the first contacts, said pushbutton having two slide grooves that respectively receive said slide blocks, movement of said pushbutton between the contact and non-contact positions resulting in a relative movement between said slide grooves and said slide blocks; and a one-piece resilient member disposed in said receiving space having an insert that engages said engaging groove, and that has opposite ends spaced apart from each other in an extending direction, and two resilient arms that extend respectively from said opposite ends of said insert and gradually away from each other, each of said resilient arms having two contact end sections that abut resiliently against said pushbutton, and that are spaced apart from each other in a transverse direction transverse to the extending direction;

wherein said resilient arms are resiliently deformed when said pushbutton moves from the non-contact position to the contact position so as to generate a restoring force which urges said pushbutton to the non-contact position.

* * * * *